US009388813B2

(12) United States Patent
Kallesøe et al.

(10) Patent No.: US 9,388,813 B2
(45) Date of Patent: Jul. 12, 2016

(54) METHOD FOR DETERMINING THE FUNCTIONAL RELATION OF SEVERAL PUMPS

(75) Inventors: Carsten Skovmose Kallesøe, Viborg (DK); Jan Carøe Aarestrup, Bjerringbro (DK)

(73) Assignee: Grundfos Management a/s, Bjerringbro (DK)

( * ) Notice: Subject to any disclaimer, the term of this patent is extended or adjusted under 35 U.S.C. 154(b) by 1358 days.

(21) Appl. No.: 13/008,964

(22) Filed: Jan. 19, 2011

(65) Prior Publication Data

US 2011/0176933 A1 Jul. 21, 2011

(30) Foreign Application Priority Data

Jan. 19, 2010 (EP) ..... 10000446

(51) Int. Cl.

| | |
|---|---|
| ***F04B 43/12*** | (2006.01) |
| ***F04B 49/06*** | (2006.01) |
| ***F04D 15/00*** | (2006.01) |
| ***F04D 13/14*** | (2006.01) |

(52) U.S. Cl.

CPC ..... *F04D 15/0066* (2013.01); *F04D 13/14* (2013.01); *F04D 15/0072* (2013.01)

(58) Field of Classification Search

CPC ..... F04B 23/06; F04B 41/06; F04B 49/08; F04B 2205/01–2205/07; F04B 49/20; F04B 2203/0209; F04D 13/12; F04D 13/14; F04D 15/0072; F04D 25/16; F04D 27/005; F04D 27/0269; F04D 15/0066; F04D 27/004; F04D 27/0261; F04D 15/0088; F04D 27/001; F04D 27/007; F04D 27/0284

USPC ..... 417/5, 6, 7, 8, 42, 279, 286, 426, 2, 18, 417/20, 22; 137/565.29, 565.3, 565.33; 702/142, 145; 73/168

See application file for complete search history.

(56) References Cited

U.S. PATENT DOCUMENTS

| | | | | |
|---|---|---|---|---|
| 2,870,716 | A * | 1/1959 | Meneley | 417/12 |
| 5,213,477 | A * | 5/1993 | Watanabe et al. | 417/20 |
| 5,797,729 | A * | 8/1998 | Rafuse, Jr. | F04B 49/20 417/3 |
| 6,464,464 | B2 * | 10/2002 | Sabini et al. | 417/19 |
| 2002/0150476 | A1 * | 10/2002 | Lucke | A61M 1/00 417/2 |
| 2005/0110655 | A1 * | 5/2005 | Layton | 340/854.9 |
| 2009/0151801 | A1 | 6/2009 | Gorman et al. | |
| 2009/0283457 | A1 * | 11/2009 | Buchanan et al. | 210/86 |

FOREIGN PATENT DOCUMENTS

| | | | |
|---|---|---|---|
| CH | 573 054 | A5 | 2/1976 |
| DE | 41 18 753 | A1 | 12/1992 |
| EP | 0 735 0273 | A1 | 10/1996 |

OTHER PUBLICATIONS

EP Search Report issued on Jul. 15, 2010 in EP Application No. 10 00 0446.4.

* cited by examiner

*Primary Examiner* — Charles Freay
*Assistant Examiner* — Amene Bayou
(74) *Attorney, Agent, or Firm* — Panitch Schwarze Belisario & Nadel LLP

(57) ABSTRACT

A method for determining the functional relationship of several pumps which are controllable in their rotational speed, in a hydraulic installation. At least one pump is activated with a changed rotational speed, and at least one functional relationship of the installation is determined from the hydraulic reactions. With a suitable selection of the control and detection of the hydraulic changes, one may determine the functional relationship of the complete installation.

25 Claims, 3 Drawing Sheets a b

| | s1 | s3 | s6 | s7 | s10 | s11 |
|---|---|---|---|---|---|---|
| pu1 | 1 | -1 | -1 | -1 | -1 | 0 |
| pu2 | 1 | -1 | -1 | -1 | -1 | 0 |
| pu3 | -1 | 1 | -1 | -1 | -1 | 0 |
| pu4 | 1 | 1 | -1 | -1 | -1 | 0 |
| pu5 | 1 | 1 | -1 | -1 | -1 | 0 |
| pu6 | -1 | -1 | 1 | -1 | -1 | 0 |
| pu7 | -1 | -1 | -1 | 1 | -1 | 0 |
| pu8 | 1 | 1 | 1 | 1 | -1 | 0 |
| pu9 | 1 | 1 | 1 | 1 | -1 | 0 |
| pu10 | -1 | -1 | -1 | -1 | 1 | 0 |
| pu11 | 0 | 0 | 0 | 0 | 0 | 1 |

a b

| | s1 | s3 | s6 | s7 | s10 | s11 |
|---|---|---|---|---|---|---|
| pu1 | 1 | -1 | -1 | -1 | -1 | 0 |
| pu2 | 1 | -1 | -1 | -1 | -1 | 0 |
| pu3 | -1 | 1 | -1 | -1 | -1 | 0 |
| pu4 | 1 | 1 | -1 | -1 | -1 | 0 |
| pu5 | 1 | 1 | -1 | -1 | -1 | 0 |
| pu6 | -1 | -1 | 1 | -1 | -1 | 0 |
| pu7 | -1 | -1 | -1 | 1 | -1 | 0 |
| pu8 | 1 | 1 | 1 | 1 | -1 | 0 |
| pu9 | 1 | 1 | 1 | 1 | -1 | 0 |
| pu10 | -1 | -1 | -1 | -1 | 1 | 0 |
| pu11 | 0 | 0 | 0 | 0 | 0 | 1 |

Fig.2
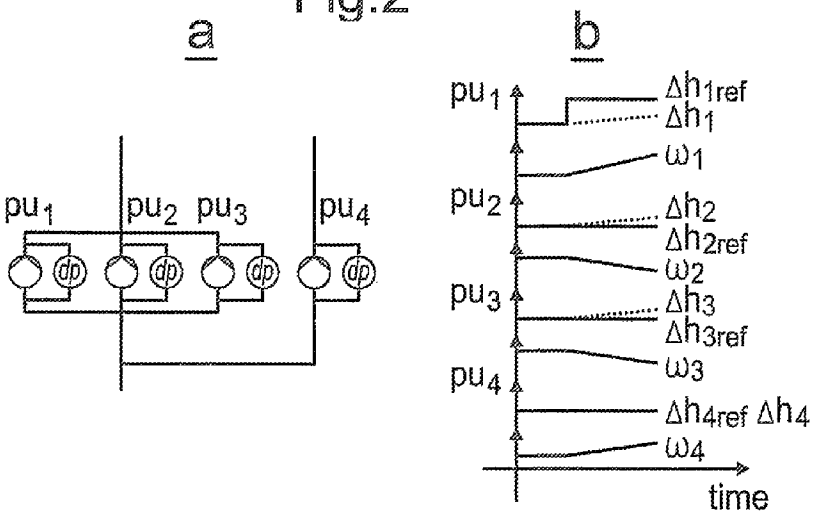
Fig.3
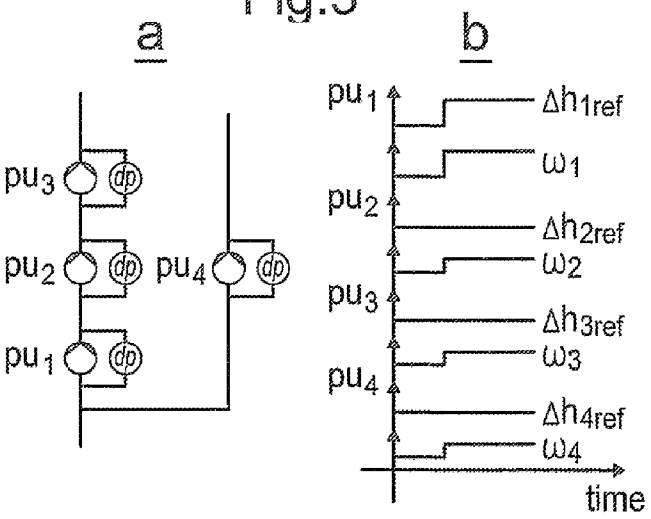
Fig.4
Fig.5

| | $q_{11}$ | $q_{10}$ | $q_7$ | $q_6$ | $q_1$ | $q_2$ | $q_3$ | $q_4$ | $q_5$ | $q_8$ | $q_9$ |
|---|---|---|---|---|---|---|---|---|---|---|---|
| pu11 | 1 | 0 | 0 | 0 | 0 | 0 | 0 | 0 | 0 | 0 | 0 |
| pu10 | 0 | 1 | -1 | -1 | -1 | -1 | -1 | -1 | -1 | -1 | -1 |
| pu7 | 0 | -1 | 1 | -1 | -1 | -1 | -1 | -1 | -1 | 1 | 1 |
| pu6 | 0 | -1 | -1 | 1 | -1 | -1 | -1 | -1 | -1 | 1 | 1 |
| pu1 | 0 | -1 | -1 | -1 | 1 | 1 | -1 | 1 | 1 | 1 | 1 |
| pu2 | 0 | -1 | -1 | -1 | -1 | 1 | 1 | 1 | 1 | 1 | 1 |
| pu3 | 0 | -1 | -1 | -1 | -1 | -1 | 1 | 1 | 1 | 1 | 1 |
| pu4 | 0 | -1 | -1 | -1 | 1 | 1 | 1 | 1 | 1 | 1 | 1 |
| pu5 | 0 | -1 | -1 | -1 | 1 | 1 | 1 | 1 | 1 | 1 | 1 |
| pu8 | 0 | -1 | 1 | 1 | 1 | 1 | 1 | 1 | 1 | 1 | -1 |
| pu9 | 0 | -1 | 1 | 1 | 1 | 1 | 1 | 1 | 1 | -1 | 1 |

D

| | $s_{11}$ | $s_{10}$ | $s_7$ | $s_6$ | $s_1$ | $s_2$ | $s_3$ | $s_4$ | $s_5$ | $s_8$ | $s_9$ |
|---|---|---|---|---|---|---|---|---|---|---|---|
| pu11 | 1 | 0 | 0 | 0 | 0 | 0 | 0 | 0 | 0 | 0 | 0 |
| pu10 | 0 | 1 | 1 | 1 | 1 | 1 | 1 | 1 | 1 | 1 | 1 |
| pu7 | 0 | 1 | 1 | 1 | 1 | 1 | 1 | 1 | 1 | -1 | -1 |
| pu6 | 0 | 1 | 1 | 1 | 1 | 1 | 1 | 1 | 1 | -1 | -1 |
| pu1 | 0 | 1 | 1 | 1 | 1 | 1 | 1 | -1 | -1 | -1 | -1 |
| pu2 | 0 | 1 | 1 | 1 | 1 | 1 | 1 | -1 | -1 | -1 | -1 |
| pu3 | 0 | 1 | 1 | 1 | 1 | 1 | 1 | -1 | -1 | -1 | -1 |
| pu4 | 0 | 1 | 1 | 1 | -1 | -1 | -1 | 1 | 1 | -1 | -1 |
| pu5 | 0 | 1 | 1 | 1 | -1 | -1 | -1 | -1 | 1 | -1 | -1 |
| pu8 | 0 | 1 | -1 | -1 | -1 | -1 | -1 | -1 | -1 | 1 | 1 |
| pu9 | 0 | 1 | -1 | -1 | -1 | -1 | -1 | -1 | -1 | 1 | 1 |

METHOD FOR DETERMINING THE FUNCTIONAL RELATION OF SEVERAL PUMPS

BACKGROUND OF THE INVENTION

The present invention relates to a method for determining the functional relation of several pumps in an installation, which may be controlled in their rotational speed.

Particularly in heating installations of larger buildings or of a more complex construction type, a multitude of pumps, i.e. centrifugal pumps, with an electric motor driving these, are installed, in order to reliably supply the individual installation parts with fluid or heat. Modern pumps of this type are typically controlled by frequency converter, so that with regard to power, they may supply over a wide range and may be operated in a different manner depending on requirement. If a multitude of such pumps cooperate in an installation, be it by way of parallel connection, series connection or a combination of this, then a complex hydraulic network results, which from the start must be known with regard to its structure, i.e. with regard to its functional relationship, in order to be able to energetically optimize the operation of the entirety of the pumps. Particularly with older installations it may be the case that the hydraulic connection plan is no longer available. Even this may no longer be unambiguously determined with a sufficient accuracy by way of the existing pipework. It is then necessary to determine the functional relationship of the pumps.

BRIEF SUMMARY OF THE INVENTION

Against this background, it is an object of the present invention to provide a method for determining the functional relationship of several pumps in an installation, which may be controlled in their rotational speed, with which this functional relationship, thus quasi the hydraulic circuit of the installation, may be determined in an unambiguous manner.

According to the present invention, the above object is achieved by the features specified in the independent claim(s). Advantageous designs of the present invention are specified in the dependent claims, the subsequent description and the drawing.

According to the present invention, the functional relationship of several pumps in an installation which are controllable in their rotational speed, is determined by way of changing the rotational speed with regard to at least one pump, and determining at least one functional relationship of the installation from the hydraulic reaction resulting therefrom. Depending on the scope of the functional relationship to be determined, one may activate one or also more pumps with a changed rotational speed, in order to determine this relationship. Thus, for example, for ascertaining whether two pumps are connected in parallel or in series, it is sufficient to activate one of the pumps with an increased rotational speed, in order then, by way of the pressure measurement or throughput measurement compared to the initial condition, to determine in which way these pumps are connected.

According to one advantageous further formation of the present invention, the method is applied in three basic method steps:

a) In a first method step, all pumps built into the installation are preferably activated with a constant rotational speed, and a hydraulic variable is detected for each pump or for each consumer assigned to the pumps or for each consumer group if several consumers are assigned to a pump. Typically, the pumps thereby are activated with a constant average rotation speed, and specifically until quasi stationary values set in. These values are detected either with regard to the pump or to the consumer, and thereby it is optionally the case of the pressure or the volume flow, wherein these do not necessarily need to be detected in a direct manner, but may also be indirectly determined in a manner known per se by way of other variables, e.g. electrical variables of the drive of the pumps manner;

b) Then one after the other, in each case one of the pumps or several pumps are activated with a changed rotational speed, and the change of the hydraulic variable which results in each case is detected. Thus, each individual pump is typically activated with a rotational speed, which is increased compared to step a), and then the changes of the hydraulic variables, which result either on the consumer side or the pump side, are detected, wherein on the part of the pump, the hydraulic variables of the pump activated with the changed rotational speed as well as those of the other pumps are detected. Basically thereby, it is of no significance as to whether the changed rotational speed is one which is increased or decreased compared to the rotational speed according to step a, but as a rule a rotation speed which is greater in comparison is advantageously selected. It is to be understood that in the same manner, one after the other, all pumps must be operated either with a rotational speed which is increased or reduced compared to the rotation speed in step a, in order to detect the hydraulic changes of the hydraulic variables which thereby result.

c) In a third method step, then after the changes of the hydraulic variables are detected, the assignment of the pumps or pump group to the consumers or consumer groups is determined by way of these detected hydraulic variable changes.

The method according to a preferred embodiment of the present invention, with the advantageous application of pumps controlled by a frequency converter, may be implemented into the digital frequency converter electronics, wherein then a data connection of the pumps amongst one another should be formed, be it wireless per radio or for example via a network cable, in order to suitably coordinate the pumps with regard to the method and furthermore to determine the hydraulic variables at the pumps or at the consumers. However, this method may also be implemented in a separate control, which is data-connected to the pumps and, as the case may be, to the consumers or their sensors in a wireless or wired manner.

The method according to a preferred embodiment of the present invention offers the huge advantage that it may be carried out with equipment which is present in the heating installation in any case, i.e. with the exception of the control and the data connection, one does not need to provide any additional measures with regard to the installation. The control and data connection may however be integrated into the pumps with only low additional costs, given a suitable design of these pumps.

The evaluation of the thus determined hydraulic variables and variable changes may be effected in a simple manner. Thereby, the methods differ essentially as to whether the hydraulic variables or their changes are detected on the part of the pump or on the part of the consumer.

If the variables are detected on the part of the consumer (on the consumer side), i.e. at a consumer or a consumer group if several consumers are assigned to a pump, then according to a further formation of the method of the present invention, at the pumps which on activation with a changed rotational speed produce the same consumer-side hydraulic variable changes, one ascertains that these are assigned to a pump group. A pump group consists of two or more pumps which are connected directly in parallel and/or series. With the consumer side variable detection, the first assignment step thus lies in determining whether the pumps are hydraulically connected as individual pumps or in groups, in the installation.

According to a further advantageous design of the method of the present invention, when, with a change in rotational speed of one or consecutively also of several pumps, only one consumer or a consumer group is influenced in an increasing or reducing manner according to the change in rotational speed, one ascertains that then the pump or the pumps are directly assigned to the respectively influenced consumer or to the respectively influenced consumer group, i.e. no further pumps are located in the conduit path between the previously mentioned pump/previously mentioned pumps, and the consumer or the consumer group.

In order to determine the functional relationship within a pump group, according to a further formation of the method according to the present invention, one envisages activating all pumps of the pump group with a constant rotational speed, thus for example according to method step a), wherein then the pressure difference produced by the respective pumps is detected at the respective pump by a differential pressure sensor. Then, one after the other, in each case one of the pumps is activated with a changed, preferably increased pressure and the differential pressure change or rotational speed changes of the other pumps which result thereby is detected, whereupon then the assignment of the pumps within the pump group is determined by way of the detected variable changes, as results by way of the hydraulic laws with the parallel connection and series connection of the pumps. In order to be able to ascertain the functional relationship within the pump group, either the pumps of a pump group are activated subsequently with a changed, preferably increased rotational speed and the throughput quantity through the respective pump is detected, or however the pumps are activated one after the other in each case for producing an increased differential pressure, wherein then the pressure levels, which sets in, of these and of the other pumps, is detected, and the assignment of the pumps within the pump group is ascertained by way of the changes which result as the case may be.

According to one advantageous further formation of the method according to the present invention, the pump or the pumps, which with their rotational speed change influence two or more consumers or consumer groups in a increasing or reducing manner according to the rotational speed change, is or are assigned according to the number of influenced consumers or consumer groups. Thus one may determine which pumps affect which consumers and thus the assignment of the pumps amongst one another may be determined.

It is particularly advantageous if, with the method according to the present invention, it is not the absolute values of the hydraulic variables or variable changes which are detected, but merely the direction, since then on the one hand one may apply a very simple sensor means which is not calibrated, and on the other hand the evaluation only requires a low computational effort as well as reduced memory requirement. Thus for carrying out the method according to the present invention, it is sufficient to detect whether the respectively detected hydraulic variable increases, reduces or remains the same, given a change in the rotational speed or pressure of a determined pump. Thus, it is merely a question of a simplified direction detection, which is adequately accurate when it may be categorized into three groups, specifically larger (+1), smaller (−1) and equal (0).

If the method according to the present invention is to be carried out by way of detecting the hydraulic variables of the pumps, thus for example the pressure or the volume flow, which as a rule, is more favorable with regard to the installation, since heating circulation pumps controlled by a frequency converter are nowadays usually equipped with differential pressure sensors, then it is useful firstly once to determine with the method as to whether the hydraulic installation is a hydraulic network or whether it consists of two or more installation parts which are independent of one another. With installation parts which are independent of one another, a rotational-speed-changed or pressure-increased activation of the pump has no influence on the other part, so that in this manner, with the method, one may firstly be able to determine the installation parts which are hydraulically connected to one another.

The method with hydraulic variables of the pump, typically pressure or differential pressure or volume flow are detected for determining the functional relationship, in turn differ fundamentally from one another.

If, as is envisaged according to a further formation of the present invention, the volume flows and thus volume flow changes as hydraulic changes are detected at all pumps, then the functional relationship of the pumps may be determined as follows, wherein hereinafter the changes on activating a pump with an increasing rotational speed are noted. However, one must emphasize that the changes may also be used in an analogous manner if the activation is effected with a reduced rotational speed:

A matrix is formed, in which the hydraulic changes of at least one hydraulically independent installation part are detected, wherein advantageously here too, the direction changes are detected, thus the matrix is formed with the values 0 for remaining the same, +1 for increasing and −1 for reducing. Thereby, for each pump, the changes of the hydraulic variables at this pump as well as at the other pumps, which result with its activation with a changed rotational speed, are specified in rows. Moreover, a column is assigned to each pump, whereby the rows within the matrix are sorted, and specifically increasing from the top to the bottom according to their number of increasing changes (+1), and the columns increasing from the left to the right according to their number of increasing changes (+1). Thus the changes of the pump which produces the fewest increasing changes in the entirety of the pumps are detected in the uppermost row of the matrix, and the associated column of this pump connects at the same location at the top left of the matrix. The pump with the most increasing changes is in the last, thus lowermost row, wherein then also the last column, thus the column at the far right, is assigned to this pump. It is to be understood that the matrix may also be arranged exactly in the reverse manner, since it is compellingly mirror-symmetrical with regard to its diagonals.

The matrix is divided by a diagonal, which runs from the one to the other matrix axis, which quasi intersects or erases the fields of the matrix in which an increasing variable change, thus typically a 1 is located. These are the fields with which the pump assignment of the column and row corresponds. By way of observing the number of increasing changes of the hydraulic variables in each column below the previously mentioned diagonal or in each row above the previously mentioned diagonal, one may determine which pumps are connected hydraulically in parallel and which ones hydraulically in series.

With the pumps with which an equal number of increasing changes (+1) of the hydraulic variables in the columns below the diagonal or in the rows above the diagonal of the matrix is given, it is the case of pumps connected in parallel, thus of those pumps which deliver from the same conduit and from the same pressure level.

According to a further formation of the method according to the present invention, pumps which are assigned directly to a consumer or to a consumer group are determined, i.e. which deliver into such a consumer or a consumer group without intermediate connection of further pumps. Hereby, it is the case of pumps with which no increasing change of the hydraulic variables in a row below the diagonal or in a column above the diagonal of the matrix is present. The first pump of the matrix may belong to this as the case may be, which is assigned to the first row and the first column and lies on the diagonal. This results from the row sorting or the column sorting.

According to a further formation of the method according to the present invention, by way of evaluating the matrix, one determines how many pumps are hydraulically connected in series upstream of the respectively considered pump. For this, the number of increasing changes of the hydraulic variables in the columns below the diagonals or in the rows above the diagonals of the matrix, are detected. This number corresponds to the number of the pumps which are connected in series upstream of the respective pump, wherein no information is given with regard to the hydraulic connection of the pumps connected in series upstream.

According to one method variant of the present invention, with which the matrix is formed in the same manner as previously described, one may determine which pumps are connected hydraulically in parallel and which ones hydraulically in series, by way of the number of increasing changes of the hydraulic variables in each row below or in each column above a diagonal dividing the matrix and running from one to the other matrix axis. Thereby, according to a further formation of the method according to the present invention, the number of increasing changes of the hydraulic variables in the rows below the diagonal or in the columns above the diagonal of the matrix may be used for determining the number of pumps which are hydraulically connected in series downstream of the respective pump, and thus the number may be assigned.

The method according to the present invention, if the hydraulic variables of the pump are evaluated, may either be carried out by way of detecting the volume flow of the pumps or however alternatively the pressure or differential pressure of the pumps. If the determining is to be effected via the pressure changes, then according to the present invention, a matrix is formed in the same manner as previously described, in which the hydraulic changes of at least one hydraulically independent installation part are detected, wherein here too in rows for each pump, the changes of the hydraulic variable which results with its activation for delivering with a changed pressure, is specified at this pump and the other pumps, and wherein a column is assigned to each pump. Thereby, the rows are sorted increasing from the top to bottom according to their number of reducing changes (−1) and the columns are sorted from the left to the right according to their number of reducing changes, wherein then one determines which pumps are hydraulically connected in parallel and which are connected hydraulically in series by way of the number of reducing changes of the hydraulic variable in each column below, or in each row above a diagonal which divides the matrix and which runs from the one to the other matrix axis. Here too, the diagonal forms a symmetrical partition of the matrix and runs through the fields which have been indicated as always increasing and which in the row and column concern the same pump in each case. These fields are not co-counted with the subsequent evaluation, just as with the previously described one.

Thereby, an equal number of reducing changes of the hydraulic variables in the columns below the diagonal or in the row above the diagonal of the matrix indicates a connection of the respective pumps in parallel.

A different number of decreasing changes of the hydraulic variables in columns below the diagonal or in rows above the diagonal indicates the connection of the respective pumps in series.

If a row below the diagonal or a column above the diagonal of the matrix has no reducing change of the hydraulic variables, then this determines the direct assignment of the respective pump to a consumer or to a consumer group.

The number of reducing changes of the hydraulic variables in the columns below the diagonal or in the rows above the diagonal of the matrix according to a further formation of the method according to the invention indicates the number of pumps which are hydraulically connected upstream in series of the respective pump.

According to a further formation of the method according to the present invention, one alternatively determines which pumps are connected hydraulically in parallel and which ones are connected hydraulically in series, by way of the number of reducing changes of the hydraulic variables in each column below, or in each row above a diagonal dividing the matrix and running from one to the other matrix axis. Thereby, the pumps which have the same number of reducing changes of the hydraulic variable in the column below, or in the row above the diagonal of the matrix, are connected hydraulically in parallel, and those with a different number are connected hydraulically in series.

According to a further formation of the method according to the present invention, the number of the reducing changes of the hydraulic variables in the rows below the diagonal or in the columns above the diagonal of the matrix indicates the number of the pumps which are hydraulically connected in series downstream of the respective pump.

Thus it becomes clear that the previously described matrix unambiguously determines the functional relationship of the pumps when the hydraulic variable change is detected at each pump. On detecting hydraulic changes at the consumer or consumer group, as the case may be, it may be necessary as initially described, to differentiate additional pump groups as to whether they are connected in parallel or series by way of changing a hydraulic variable of the pump.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings:

FIG. 2*a* is a circuit diagram of four pumps arranged in parallel in accordance with a preferred embodiment of the present invention;

FIG. 2*b* shows the temporal behavior of the pumps with a pressure increase;

FIG. 3*a* is a circuit diagram of a pump group of pumps arranged in parallel and in series;

FIG. 3*b* shows the behavior of the pumps with an activation with a changed rotational speed;

FIG. 4*a* is a circuit diagram of three pumps arranged in parallel;

FIG. 4*b* shows the behavior of the pumps with a change in rotational speed;

FIG. 5*a* is a circuit diagram of three pumps arranged in series;

FIG. 5*b* shows the behavior of the pumps with activation with a change in rotational speed;

DETAILED DESCRIPTION OF THE INVENTION

Figure 1:
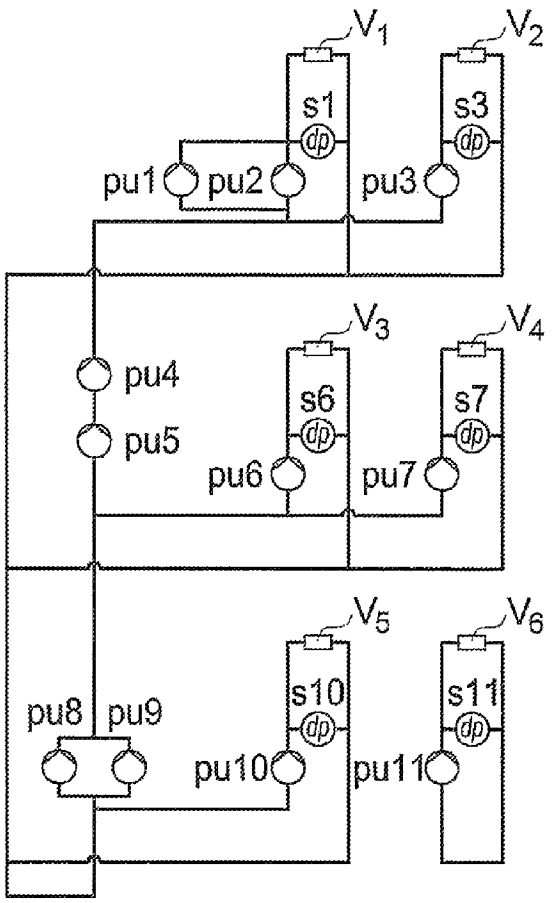
FIG. 1*a* is a hydraulic circuit diagram of an installation with several pumps and consumers according to a preferred embodiment of the present invention.
FIG. 1*b* is a matrix with regard to the installation according to FIG. 1*a;*
Figures 6, 7, 8:
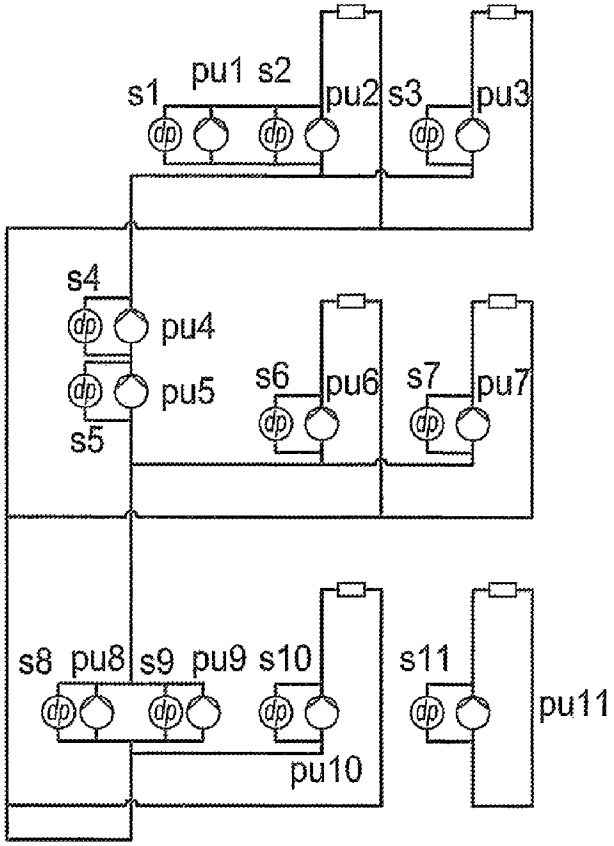
FIG. 6 is a hydraulic circuit diagram of a hydraulic installation according to FIG. 1, but with a pump-side sensor arrangement.
FIG. 7 is a first matrix with regard to the installation according to FIG. 6.
FIG. 8 is a second matrix with regard to the installation according to FIG. 6.

The hydraulic installation represented by way of FIG. 1 and FIG. 6 is a heating installation which here is not to be explained in detail because such an explanation is not necessary to a full and complete understanding of the present invention. The hydraulic installation is equipped as a whole with 11 pumps PU1-PU11. These in total eleven (11) pumps supply six (6) consumers V1-V6. These consumers may be individual consumers, but are typically consumer groups such as, for example, a network of heat exchangers connected in parallel, as is normal in the construction of apartments for room heating, which as the case may be, may also be connected in groups in parallel and/or in series. A sensor S1, S3, S6, S7, S10, S11 is assigned to each consumer and detects the pressure dropping at the consumer.

The installation preferably consists of two installation parts which are hydraulically independent of one another, specifically of the installation part represented at the bottom right in FIG. 1*a* consisting of the pump PU11 and the consumer V6, as well as the remaining installation part. In the remaining installation part, in the lowermost plane, a pump PU10 supplies a consumer V5, parallel to this, two pumps PU8 and PU9 connected in parallel feed the consumer V3 via a pump PU6 connected in series downstream, as well as parallel to this, the consumer V4 via a pump PU7 connected in series downstream. The pumps PU1, PU2 and PU3 are supplied via the pumps PU5 and PU4 connected in series and for their part however connected in parallel supply the consumer V1 and the consumer V2 respectively. This arrangement is preferably selected at random and exclusively serves for illustrating the method according to the invention.

For carrying out the method, now firstly, all pumps PU1 to PU11 are preferably activated with a constant rotational speed, typically of a medium rotational speed which is selected such that the installation is operated according to directed use, but reserves are present so that the pumps, as the case may be, may be activated with a rotational speed which is increased with respect to this. With regard to the pumps, it is typically the case of heating circulation pumps, which are controlled by frequency converter, as are normal in the market.

All pumps are operated at a constant rotational speed and this rotational speed should be constant with respect to the respective pump, but of course the rotational speeds may differ amongst one another. If one of the pumps during the method must be activated with a changed rotation speed on account of a requirement on the part of the installation, then this may be effected when the correspondingly changed rotational speed is taken numerically into account. Pressures are detected at the sensors S1, S3, S6, S7, S10, S11 during this activation with constant rotational speed. Now a first pump, e.g. the pump PU1 is activated with a changed rotational speed, for example with an increased rotational speed and the changes which set in as the case may be or also the non-changes, are detected by way of the sensors S1, S3, S6, S7, S10, S11.

A matrix is usefully set up for this, as is represented in FIG. 1*b*. In the matrix, the pumps PU1-PU11 are listed on the one axis, which here is vertical, and the sensors S1-S11 on the other, here horizontal axis, in order then in the fields which results with this, to detect whether and, as the case may be, which hydraulic changes result on activating a pump with an increased rotational speed. Thereby a categorization in 0, −1 and 1 is effected, wherein 0 indicates no change, 1 an increasing hydraulic variable and −1 a reducing hydraulic variable.

On activating the pump PU1 with an increased rotational speed, thus according to FIG. 1*b*, an increasing pressure difference results at the sensor S1, a reducing pressure difference at the sensor S3, a reducing pressure difference at the sensor S6, a reducing pressure difference at the sensor S7 and likewise a reducing pressure difference at the sensor S10, compared to a prior activation of this pump PU1 at a reduced rotational speed. The sensor S11 detects no change since it relates to an installation part which is not hydraulically connected to the pump PU1. If these changes are detected, the pump PU1 is moved down again to the previously activated constant first rotational speed, whereupon now the pump PU2 is activated with an increased rotational speed and the changes resulting at the sensors S1-S11 are plotted in the matrix. This is effected hereinafter with all pumps until the matrix is set up completely as in FIG. 1*b*.

The matrix representation here is set up only for a simplified numbered representation, but is basically not necessary for evaluation. By means of the activation it may now be ascertained for starters that the pumps PU1-PU10 have no influence on the sensor S11 whatsoever and thus on the consumer V6. Vice versa the pump PU11 has no influence at all on the consumers V1-V5 from which it results that it hereby must be the case of two installation parts which are independent of one another, wherein pump PU11 evidently only supplies the consumer V6.

With the remaining installation part, which comprises the pumps PU1-PU10, firstly one examines which pumps are arranged in pump groups, i.e. which pumps are connected into a group in parallel or series. The pumps which on the consumer side cause the same hydraulic changes with a change of their rotational speed, are connected into groups. This, as is to be deduced from the matrix according to FIG. 1*b*, is the case for the pumps PU8 and PU9, for the pumps PU1 and PU2 as well as for the pumps PU4 and PU5. These pumps are thus identified as groups and one thus should yet determine whether these in each case are connected in series or in parallel, which is described further below.

One then determines which pumps, with a change of rotational speed, influence only one consumer or only one consumer group according to the rotation speed change, i.e. with an increase in rotational speed influence in a pressure increasing manner and with a rotational speed reduction in a pressure-reducing manner. Since, with the embodiment example which is represented by way of FIG. 1, one has assumed that the pumps in method step b are activated with an increased rotational speed compared to the previous lower constant rotational speed, it results that they only have one positive 1 in the row. It is the pumps PU1, PU2, PU3, PU6, PU7, PU10 and of course PU11 which belong to the other installation part. These pumps are directly assigned to a consumer, i.e. they supply the consumer without intermediate connection of further pumps.

However, one may not only ascertain by way of these assignments as to which pumps are directly assigned to a consumer, but moreover which consumers are supplied by which pumps at all. Thus, it is evident that the pump PU10 only affects the consumer V5 and this in a direct manner. With regard to the pump group PU8 and PU9, one may recognize that these influence the sensors S1, S3, S6, S7 in the same direction, i.e. that with an activation of the pump with an increased rotational speed, a higher pressure drops at these sensors, i.e. an increasing pressure change is given. This says that the pumps PU8 and PU 9 feed the consumers V1-V4 but only indirectly, i.e. that yet other pumps need to be intermediately connected. With regard to the pumps PU4 and PU5, one may ascertain in the same manner that they supply the consumers S1 and S3, but however likewise only in an indirect manner, since the consumers V3 and V4 are directly supplied by the pumps PU6 and PU7 respectively, and since the pumps PU4 and PU5 as a pump group however do not influence these consumers in the same direction, it results that the pump group PU4 and PU5 as well as the pump PU6 and the pump PU7 are connected in parallel, wherein the pumps PU6 and PU7 in each case are assigned to the associated consumers V3 and V4, whereas the pump group PU4 and PU5 affect the consumers V1 and V2, but likewise not in a direct manner.

Inasmuch as this is concerned, one merely yet needs to determine how the pump groups are connected. These three groups of pumps PU8 and PU9, PU4 and PU5 as well as PU1 and PU2 therefore need to be examined further as far as this is concerned. However further sensors are required for this, which detect the differential pressure of the respective pumps of the pump group or the throughput. With the embodiments according to FIGS. 2 and 3, the differential pressure sensors are applied parallel to the pump, whereas with the embodiments according to the FIGS. 4 and 5, volume flow sensors, namely so-called throughput meters, are assigned to the pumps. Irrespective of which sensors are applied, again the previously described method is applied for determining the arrangement of the pumps in a pump group, i.e. the pumps are firstly represented as by way of FIGS. 4 and 5, operated with a constant rotational speed, whereupon a pump, here the pump PU1, is activated with an increased rotational speed. By way of the changing volume flow of this and of the other pumps, one may now determine whether the pumps arranged into a pump group are connected in series or in parallel. With a parallel connection according to FIG. 4*a*, with an activation of a pump, here pump the PU1 with an increased rotational speed ω1 of this pump, an increased throughput q1 results, whereas the other two pumps PU2 and PU3 continue to run with the previous constant rotational speed, but have a reduced flow volume rate q2 and q3 respectively. It directly results from this, that the pumps must be connected in parallel, since otherwise the delivery rates would have to increase as is illustrated by way of FIG. 5, where three pumps PU1-PU3 are connected in series. If here the pump PU1 is activated with an increased rotational speed ω1, an increased throughput quantity q1, q2 and q3 of all three pumps thus results despite a constant rotational speed of the pumps PU2 and PU3.

If the arrangement of the pumps is to be determined by way of pressure sensors thus differential pressure sensors parallel to the pump, then one of the pumps of a pump group after all have been activated for producing a constant pressure, activates one of the pumps for producing this increased pressure. This is effected with the examples according to FIG. 2 and FIG. 3 in each case with the pump PU1. On may deduce from FIG. 2*b* as to the temporal course of the change of the hydraulic variables. After the pressure jump of the pump PU1, the pressure at the pumps PU2, PU3 and PU4 remains practically unchanged, wherein the rotational speeds of the pumps PU2 and PU3 reduce with a slightly increasing pressure, which may be deduced as a parallel connection, whereas the rotational speed of the pump PU4 with a constant pressure increases, which indicates that this pump does not belong to the pumps connected in parallel. Analogously, with the series connection of the pumps PU1, PU2 and PU3 into a group, a pressure change only at the pump PU1 and with all other pumps merely a rotation speed change and specifically in an increasing manner, results.

As the above explanations illustrate, thus the circuit diagram according to FIG. 1*a* may be completely determined. Since with the previously described method, only one sensor is assigned to only each consumer or each consumer group, the separate sensor means must be applied on the part of the pump in the pump groups for determining the arrangement of the pumps.

Inasmuch as this is concerned, it is often more favorable to design the method according to the present invention exclusively with pump-side pressure sensors, differential pressure sensors and throughput sensors, as this is represented by way of the FIGS. 6-8. This method takes its course in the same manner, i.e. firstly in a first method step, all pumps are activated with a constant rotation speed and then in a second method step subsequently all pumps are activated individually and one after the other with a rotational speed which is changed with respect to this, typically an increased rotational speed. The resulting changes are recorded in a matrix, as is represented by way of FIG. 7 for the throughput measurement of the pumps and by way of FIG. 8 for the differential pressure measurement at the pumps. Thereby, the matrix is formed in the same manner as that described by way of FIG. 1*b*, i.e. 0 stands for no change of the hydraulic variable of the respective sensor on activating the respective pump with an increased rotational speed, 1 for an increasing change and −1 for a reducing change.

For the evaluation of the matrix according to FIG. 7, it is however necessary to previously sort this according to rows. With the detection of the volume flow changes as are drawn in FIG. 7, the sorting of the rows is effected according to the number of increasing changes from the top to bottom. Thus the uppermost row concerning pump PU7 has one 1, specifically at q11. The row PU10 arranged therebelow also has only one 1, specifically at q10. The rows PU7 and PU6 in each case have three increasing changes, the rows PU1, PU2 and PU3 in each case 5 increasing changes, the rows PU4 and PU5 7 increasing changes and the rows PU8 and PU9 8 increasing changes. The rows are sorted in an increasing manner from the top to bottom according to this sequence. Thereby, a pump is assigned to each row and the sensor assigned to the pump in each case is assigned to each column. The columns are sorted in an increasing manner in the same manner as the pumps, but from the left to the right, so that a mirror-symmetry of the matrix with respect to a diagonal D, which is formed by the fields which relate to the same pumps, results. This diagonal extends from the top left to the bottom right in the matrix beginning from the field PU11, q11 to the field PU9, q9.

The functional relationship, i.e. the construction of the installation may be directly evaluated by way of this matrix. Thus, firstly in the same manner as with the first embodiment example, by way of the zeros in the first column below the diagonal or in the first row above the diagonal, one may ascertain that the pumps PU1-PU10 belong to a different installation part than the pump PU11, since this pump only influences its own sensor q11.

By way of the number of increasing changes, thus the numbers 1 of the throughput in each gap below the diagonal D or in each row above the diagonal D which divides the matrix, it results as to which pumps are hydraulically connected in parallel and which are hydraulically connected in series. An equal number as occurs for example in the columns q7 and q6 and q5 in FIG. 7 below the diagonal D, indicates that these pumps are arranged in parallel, whereas a number differing with respect to this, such as for example at q4—here it is three—indicates that this pump PU5 does not lie in parallel but in series with one of the previously mentioned pumps. As to how the arrangement is given, results from the number of increasing changes. Thereby, the number of increasing changes of the hydraulic variables in the columns below the diagonals or, since it is mirror-symmetrical, in the rows above the diagonal, indicates the number of the pumps which are hydraulically connected in series upstream of the respective pump. Thus, for example, the pump PU1 to which the sensor q1 is assigned, is characterized by four ones in the column q1 below the diagonal, i.e. four increasing changes of the hydraulic variables, which means that four pumps are connected in series upstream of the pump PU1. This may thus be determined for each of the pumps.

Moreover, one may ascertain which of the pumps are directly assigned to a consumer or to a consumer group, and here it is specifically the case of the pumps with which no increasing change of the hydraulic variables in a row below the diagonal or a column above the diagonal of the matrix is plotted. This for example applies to the pump PU7, in whose associated rows in FIG. 7 below the diagonal there are only the numerals 0 and −1, in the same manner for PU6 there are the numerals 0, −1, −1, etc. Thus, one may ascertain by way of these details as to how many pumps are connected in series upstream of the respective pump and which pumps connect directly to a consumer or consumer group. Thus, the circuit arrangement according to FIG. 6 is unambiguously defined.

Moreover, in FIG. 7, one may determine which pumps are connected hydraulically in parallel and which in series by way of the number of increasing changes of the hydraulic variable in each row below, or in each column above, the diagonal of the matrix. The number of increasing changes (+1) thereby indicates the number of pumps which are hydraulically connected in series downstream of this pump. Thus, in FIG. 7, the pump PU8 in row 7 has ones below the diagonal D, which means seven pumps are connected in series downstream of this pump. Thereby, it is the case of the pumps PU1-PU7. If in FIG. 7, below PU4, one reads the row below the diagonal D, then three ones result, i.e. three pumps are connected in series downstream. Thereby, it is the case of the pumps PU1-PU3 as the circuit diagram according to FIG. 6 illustrates.

In an analogous manner, the evaluation of the matrix according to FIG. 8, with which instead of throughput changes q, the pressure changes s are specified. However, here it is not the increasing changes 1, but the reducing changes −1 which are used for evaluation, but otherwise the evaluation is effected the same manner as described by way of FIG. 7.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method for determining functional relationships between pumps controlled by a digital frequency converter in an installation, the pumps being controllable with regard to their rotational speed, wherein rotational speed of at least one pump is changed, and at least one functional relationship of the installation is determined from a hydraulic reaction resulting therefrom, the method comprising:

a) activating all of the pumps with a constant rotational speed, and detecting, using sensors, a single hydraulic variable for each pump or a consumer or group of consumers being assigned to a respective pump;

b) activating in each case at least one of the pumps in a successive manner with a changed rotational speed compared to step a), and detecting, using the sensors, the respective resulting changes to the hydraulic variable for each pump or each consumer or group of consumers assigned to a respective pump; and c) determining, via electronics of the digital frequency converter, an assignment of the pumps or pump groups to the consumers or groups of consumers by the hydraulic variable changes detected by the sensors.

2. The method according to claim 1, wherein pumps that produce the same consumer-side hydraulic variable changes when activated with a changed rotational speed are assigned to a pump group.

3. The method according to claim 1, wherein the pump or pumps which with their rotational speed change only influence the hydraulic variable for one consumer or one group of consumers in an increasing or decreasing manner according to the rotational speed change, are directly assigned to the respectively influenced consumer or the respectively influenced group of consumers.

4. The method according to claim 1, wherein the pump or pumps, which with their rotational speed change influence the hydraulic variable for two or more consumers or groups of consumers in an increasing or reducing manner according to the rotational speed change, are assigned according to the number of influenced consumers or groups of consumers.

5. The method according to claim 1, wherein the detected hydraulic variable is pump throughput.

6. The method according to claim 1, wherein the functional relationship of a pump group is determined by activating all pumps of a pump group with a constant rotational speed for producing a pressure difference, detecting the produced pressure difference of each pump of the pump group, activating successively in each case one of the pumps of the pump group with a changed pressure, and detecting resulting differential pressure changes or rotational speed changes in each case, and determining the assignment of the pumps within the pump group by the detected changes.

7. The method according to claim 1, wherein the change to the hydraulic variable is only detected as a change in direction of a hydraulic variable value.

8. The method according to claim 7, wherein the change in direction of the hydraulic variable value is categorized as one of larger (+1), smaller (−1) and the same (0).

9. The method according to claim 1, wherein one determines which pumps belong to which hydraulically independent installation parts by the respective hydraulic variable of the pumps, which does not change.

10. The method according to claim 1, wherein volume flow is the detected hydraulic variable.

11. The method according to claim 10, wherein the determining step comprises forming a matrix having a column assigned to each pump, in which change of the hydraulic variable of at least one hydraulically independent installation part are detected, wherein for each respective pump activated with a changed rotational speed, the detected resulting change to the hydraulic variable at each of the pumps is specified in a same row, the rows being sorted in an increasing manner from top to bottom according to the number of hydraulic variable increases, and the columns being sorted in an increasing manner from left to right according to the number of hydraulic variable increases, and one determines which pumps are connected hydraulically in parallel and which are connected hydraulically in series by the number of hydraulic variable increases in each column below or in each row above a diagonal dividing the matrix and running from one matrix axis to the other matrix axis.

12. The method according to claim 11, wherein an equal number of hydraulic variable increases in columns below the diagonal or in rows above the diagonal of the matrix, indicates connection of the respective pumps in parallel.

13. The method according to claim 11, wherein a different number of hydraulic variable increases in columns below the diagonal or in rows above the diagonal of the matrix, indicates connection of the respective pumps in series.

14. The method according to claim 11, wherein no presence of hydraulic variable increases in a row below the diagonal or a column above the diagonal of the matrix, indicates the direct assignment of the respective pump to a consumer or group of consumers.

15. The method according to claim 11, wherein the number of hydraulic variable increases in the columns below the diagonal or in the rows above the diagonal of the matrix, indicates the number of pumps which are hydraulically connected in series upstream of the respective pump.

16. The method according to claim 10, wherein the determining step comprises forming a matrix having a column assigned to each pump, in which changed of the hydraulic variable of at least one hydraulically independent installation part are detected, wherein for each respective pump activated with a changed rotational speed, the detected resulting change to the hydraulic variable at each of the pumps is specified in a same row and the rows are sorted in an increasing manner from top to bottom according to the number of hydraulic variable increases, and the columns are sorted in an increasing manner from left to right according to the number of hydraulic variable increases, and one determines which pumps are connected hydraulically in parallel and which pumps are connected hydraulically in series by the number of hydraulic variable increases in each row below, or in each column above a diagonal which divides the matrix and runs from one matrix axis to the other matrix axis.

17. The method according to claim 16, wherein the number of hydraulic variable increases in the rows below the diagonal or in the columns above the diagonal of the matrix, indicates the number of pumps hydraulically connected in series downstream of the respective pump.

18. The method according to claim 16, wherein pressure is the detected hydraulic variable.

19. The method according to claim 10, wherein the determining step comprises forming a matrix having a column assigned to each pump, in which change of the hydraulic variable of at least one hydraulic independent installation part are detected, wherein for each respective pump activated with a changed rotational speed, the detected resulting change to the hydraulic variable at each of the pumps is specified in a same row, the rows being sorted in an increasing manner from top to bottom according the number of hydraulic variable decreases, and the columns being sorted in an increasing manner from left to right according to the number of hydraulic variable reductions and one determines which pumps are connected hydraulically in parallel and which pumps are connected hydraulically in series by the number of hydraulic variable reductions in each column below or in each row above a diagonal dividing the matrix and running from one matrix axis to the other matrix axis.

20. The method according to claim 19, wherein an equal number of hydraulic variable reductions in columns below the diagonal or in rows above the diagonal of the matrix, indicates connection of the respective pumps in parallel.

21. The method according to claim 19, wherein a different number of hydraulic variable reductions in columns below the diagonal or in rows above the diagonal of the matrix, indicates connection of the respective pumps in series.

22. The method according to claim 19, wherein no presence of hydraulic variable reduction in a row below the diagonal or a column above the diagonal of the matrix, indicates a direct assignment of the respective pump to a consumer or group of consumers.

23. The method according to claim 19, wherein the number of hydraulic variable reductions in the columns below the diagonal or in the rows above the diagonal of the matrix, indicates the number of pumps hydraulically connected in series upstream of the respective pump.

24. The method according to claim 10, wherein the determining step comprises forming a matrix having a column assigned to each pump, in which changes of the hydraulic variable of at least one hydraulically independent installation part are detected, wherein for each respective pump activated with a changed rotational speed, the detected resulting change to the hydraulic variable at each of the pumps are specified in a same row, the rows being sorted in an increasing manner from top to bottom according to the number of hydraulic variable reductions and the columns being sorted in an increasing manner from left to right according to the number of hydraulic variable reductions, and one determines which pumps are connected hydraulically in parallel and which pumps are connected hydraulically in series by the number of hydraulic variable reductions in each column below or in each row above a diagonal which divides the matrix and which runs from one matrix axis to the other matrix axis.

25. The method according to claim 24, wherein the number of hydraulic variable reductions in the rows below the diagonal or in the columns above the diagonal of the matrix, indicates the number of pumps which are hydraulically connected downstream of the respective pump.

* * * * *